US009968942B2

(12) United States Patent
Gillespie

(10) Patent No.: US 9,968,942 B2
(45) Date of Patent: May 15, 2018

(54) METHOD AND APPARATUS FOR SEPARATING CONTAMINANTS FROM COMPOST AND OTHER RECYCLABLE MATERIALS

(71) Applicant: BOREAL COMPOST ENTERPRISES LTD., Whitehorse (CA)

(72) Inventor: Garret Gillespie, Whitehorse (CA)

(73) Assignee: BOREAL COMPOST ENTERPRISES LTD., Whitehorse (CA)

( * ) Notice: Subject to any disclaimer, the term of this patent is extended or adjusted under 35 U.S.C. 154(b) by 0 days. days.

(21) Appl. No.: 15/196,647

(22) Filed: Jun. 29, 2016

(65) Prior Publication Data

US 2018/0001323 A1 Jan. 4, 2018

(51) Int. Cl.

| | |
|---|---|
| ***B07B 9/00*** | (2006.01) |
| ***B03B 4/06*** | (2006.01) |
| ***B03B 4/00*** | (2006.01) |
| ***B03B 9/06*** | (2006.01) |

(52) U.S. Cl.

CPC ..... *B03B 4/065* (2013.01); *B03B 4/005* (2013.01); *B03B 9/06* (2013.01)

(58) Field of Classification Search

CPC ..... B03B 4/005; B03B 4/065; B03B 9/06
USPC ..... 209/12.1, 21, 34, 35, 36, 37
See application file for complete search history.

(56) References Cited

U.S. PATENT DOCUMENTS

| | | | | |
|---|---|---|---|---|
| 1,987,640 | A * | 1/1935 | Rothgarn | B07B 4/04 123/169 EL |
| 2,221,444 | A * | 11/1940 | Dodge et al. | 209/13 |
| 2,239,396 | A * | 4/1941 | Mowry | B03B 5/04 209/197 |
| 2,378,356 | A * | 6/1945 | Erck | B03B 5/52 209/17 |
| 2,645,821 | A * | 7/1953 | Fowler | A01D 46/10 209/137 |
| 2,967,616 | A * | 1/1961 | Philippbar | B02B 1/02 209/317 |
| 3,392,491 | A * | 7/1968 | Vogt | B07B 1/00 209/240 |
| 4,754,864 | A * | 7/1988 | Cross, Jr. | B65G 47/766 198/364 |
| 5,006,226 | A * | 4/1991 | Burt, Jr. | B03B 4/00 209/130 |

(Continued)

*Primary Examiner* — Terrell H Matthews
(74) *Attorney, Agent, or Firm* — Tai W. Nahm; Miller Thomas, LLP

(57) ABSTRACT

There is disclosed a method and apparatus for separating stones, fibers and plastics from biodegradable material. In an embodiment, the apparatus comprises: an inclined trough having a feed entry at a top end for receiving the feed material, the inclined trough including a plurality of riffles angled to at least partially hinder and unsettle a flow of the feed material flowing down the inclined trough; one or more vibratory motors configured to induce a vibration in the inclined trough; one or more blowers configured to generate an air flow through overhead air vent nozzles positioned over the inclined trough and directing the air flow to one side of the inclined trough; and a material resilience separator for separating the contaminants from the biodegradable materials in the remaining material.

10 Claims, 7 Drawing Sheets

(56) References Cited

U.S. PATENT DOCUMENTS

| | | | | | |
|---|---|---|---|---|---|
| 5,045,182 | A * | 9/1991 | Butler | B07B 1/46 | 209/240 |
| 5,294,065 | A * | 3/1994 | Harms | B28C 9/04 | 241/101.76 |
| 5,407,079 | A * | 4/1995 | Rancourt | B07B 7/06 | 209/142 |
| 7,108,138 | B2 * | 9/2006 | Simpson | B01D 45/12 | 209/154 |
| 8,016,119 | B2 * | 9/2011 | Legtenberg | B07B 13/003 | 209/615 |
| 8,286,800 | B2 * | 10/2012 | Kojima | B07C 5/368 | 209/552 |
| 8,944,255 | B2 * | 2/2015 | Ito | B07C 5/02 | 209/576 |
| 9,033,157 | B2 * | 5/2015 | Berkhout | B07B 13/10 | 209/644 |
| 2003/0098264 | A1 * | 5/2003 | Ingels | B01J 2/16 | 209/474 |
| 2007/0023327 | A1 * | 2/2007 | Li | B03B 4/02 | 209/44 |
| 2008/0223770 | A1 * | 9/2008 | Legtenberg | B07B 13/003 | 209/707 |
| 2010/0270216 | A1 * | 10/2010 | Burnett | B01D 33/0376 | 209/606 |
| 2011/0084005 | A1 * | 4/2011 | Berkhout | B07B 15/00 | 209/642 |

* cited by examiner

METHOD AND APPARATUS FOR SEPARATING CONTAMINANTS FROM COMPOST AND OTHER RECYCLABLE MATERIALS

FIELD OF THE INVENTION

The present disclosure relates generally to a method and apparatus for separating contaminants such as stones, glass and synthetic materials such as fibers and plastics from compost and other recyclable materials.

BACKGROUND OF THE INVENTION

With increasing awareness of potential damage to the environment resulting from recyclables directed to waste landfill dumps or incineration, more industries and municipalities are implementing waste diversion and recycling programs to significantly reduce the volume of waste that must be processed in a conventional manner. However, as the rate of waste diversion and recycling has increased, processing facilities have found that certain recyclables, in particular compostable materials, have increasingly become contaminated with synthetic materials such as fibers and plastics due to improper separation. Furthermore, undesirable stone and glass are often mixed with biodegradable materials when collected for recycling.

Municipal and industrial compost facilities in North America and in other jurisdictions are struggling with a growing contamination problem as they attempt to recycle biodegradable materials in an efficient and cost effective manner. A particular challenge is that there are stones, glass, and numerous types of synthetic materials such as fibers and plastics found in compost which are diverse in shape, size and density. Fibers may vary in shape, size and density, ranging from natural and synthetic textiles such as cotton, wool, burlap, polyester fiber and nylon from apparel, furniture, carpeting, rags, wipes, scrub pads, rope, string, etc. Plastics may vary considerably in shape, size and density, ranging from larger pieces of solid plastics, to thin strips of plastics torn from plastic bags and packaging. Furthermore, biodegradable material often has high moisture content, making effective separation of stone, fibers and plastics from the organic materials technically challenging. These technical challenges result in increased wear on processing machinery, increased labor and operating costs, and a reduction in the market value of the finished compost product. At worst, the processed compost may be so contaminated by that it is unusable altogether and must ultimately be discarded as waste, thereby defeating the purpose of diverting and recycling in the first place.

In U.S. Pat. No. 8,910,797, an earlier patent issued to the present inventor, a novel method and apparatus was disclosed for separating plastics from compost and other recyclable materials. While the method and apparatus described in the issued patent was effective for removal of a substantial amount of plastics contaminants, it was found that other types of contaminants such as stones, glass and other synthetic materials remained in the compost after processing.

Therefore, what is needed is a further improved method and apparatus for separating stones, glass, fibers and plastics contaminants from biodegradable materials that overcomes at least some of the limitations in the prior art.

SUMMARY OF THE INVENTION

The present disclosure relates generally to a method and apparatus for separating contaminants such as stones, glass, fibers and plastic contaminants from compost and other recyclable materials. The method and apparatus can effectively remove stones, glass, fibers and plastics contaminants of all shapes and sizes and varying density from recyclable biodegradable materials (e.g. compost, food waste, yard waste, and woodchips) under a wide range of moisture content conditions.

In an aspect, there is provided an apparatus for separating stones, glass, and synthetic materials such as fibers and plastics from compost and other recyclable materials, comprising: an inclined trough having a feed entry at a top end for receiving the feed material, the inclined trough including a plurality of riffles angled to at least partially hinder and unsettle a flow of the feed material flowing down the inclined trough; one or more vibratory motors configured to induce a vibration in the inclined trough; one or more blowers configured to generate an air flow via overhead air vent nozzles positioned over the inclined trough and directing the air flow over the feed material and to one side of the inclined trough, thereby to remove synthetic materials; and a material resilience separator adapted to launch the feed material across a plurality of bins, such that the stones and glass, biodegradable materials, and synthetic fibers in the feed material are separated into different bins based on their respective resilience (hardness) and coefficient of drag.

In an embodiment, the material resilience separator comprises of an inclined plate situated below the lowest end of the inclined trough. The angle of the plate is such that hard material such as stone and glass will bounce somewhat and separate from the softer organic material which will fall directly off the plate without bouncing. As the material types fall under the force of gravity, a clear split occurs between the material types. An adjustable knife is adapted and situated between the separated fractions to improve the efficiency of the split across the plurality of bins.

In another embodiment, the angle of the inclined plate is adapted to be controlled to increase separation of the stones and glass, biodegradable materials, and fibers between the plurality of bins.

In another embodiment, the overhead air vent nozzles are adjustable to vary the amount of air flow across the inclined trough.

In another embodiment, the overhead air vent nozzles are adjustable to change the angle of air flow across the inclined trough.

In another embodiment, flexible skirts are positioned perpendicularly to the inclined trough and on either side of a set of overhead air vent nozzles to create a compartmentalized air flow corridor across the inclined trough.

In another embodiment, the apparatus further comprises a bar screen located at the feed entry to separate the incoming feed material.

In another embodiment, the apparatus includes at least one cross conveyor to change the direction of the processed feed material at least once.

Other features and advantages of the present invention will become apparent from the following detailed description and accompanying drawings. It should be understood, however, that the detailed description and specific examples are given by way of illustration and not limitation. Many modifications and changes within the scope of the present invention may be made without departing from the spirit thereof, and the invention includes all such modifications.

Figure 1:
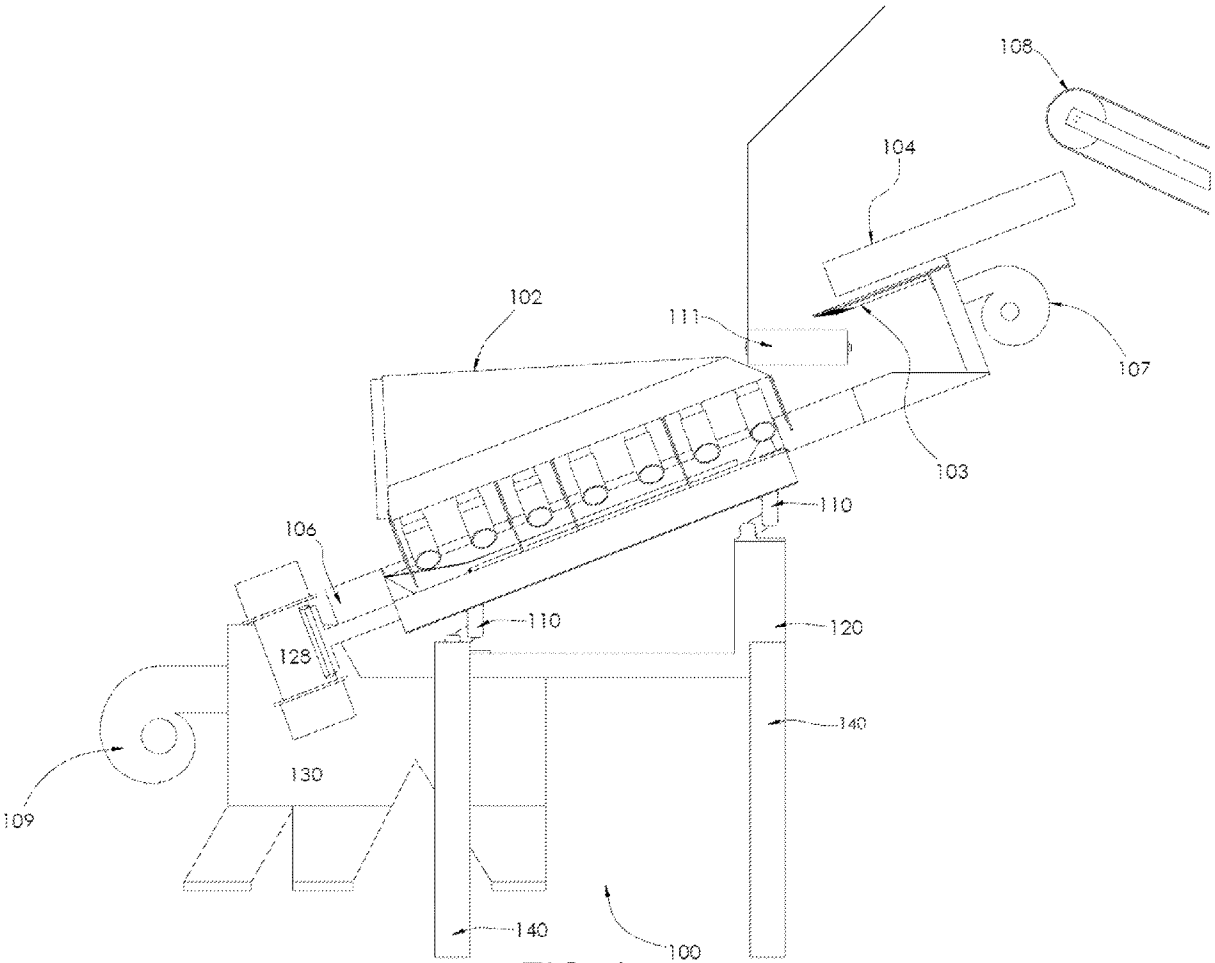
FIG. 1 shows an illustrative example of an apparatus in accordance with an illustrative embodiment.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION

As noted above, the present disclosure relates generally to a method and apparatus for separating contaminants such as stones, glass, fibers and plastics from compost and other recyclable materials. The method and apparatus can effectively remove these different types of contaminants of all shapes and sizes from recyclable biodegradable materials under a wide range of moisture content conditions.

In an aspect, there is provided an apparatus for separating contaminants such as stones, glass, and synthetics such as fibers and plastics from compost and other recyclable materials, comprising: an inclined trough having a feed entry at a top end for receiving the feed material, the inclined trough including a plurality of riffles angled to at least partially hinder and unsettle a flow of the feed material flowing down the inclined trough; one or more vibratory motors configured to induce a vibration in the inclined trough; one or more blowers configured to generate an air flow via overhead air vent nozzles positioned over the inclined trough and directing the air flow over the feed material and to one side of the inclined trough, thereby to remove plastics; and a material resilience separator adapted to launch the feed material across a plurality of bins, such that the stones and glass, biodegradable materials, and fibers in the feed material are separated into different bins based on their respective resilience (hardness) and coefficient of drag.

In an embodiment, the material resilience separator comprises of an inclined plate situated below the lowest end of the inclined trough. The angle of the plate is such that hard material such as stone and glass will bounce somewhat and separate from the softer organic material which will fall directly off the plate without bouncing. As the different material types fall under the force of gravity, a clear split occurs between the material types. A discharge hopper system has been devised with adjustable blades located between and dividing the bins to improve the efficiency of the split across the plurality of bins.

In another embodiment, the angle of the inclined plate is adapted to be controlled to increase separation of the stones and glass, biodegradable materials, and fibers between the plurality of bins, given a variation in feed material moisture content.

In another embodiment, the bins have adjustable blades which can control the width of at least one of the bins, thereby providing further control over separation of the different types of materials.

In another embodiment, a blower is adapted to be controlled to increase separation of the stones and glass, biodegradable and fibers between the plurality of bins.

In another embodiment, the overhead air vent nozzles are adjustable to vary the speed and volume of air flow across the inclined trough.

In another embodiment, the overhead air vent nozzles are adjustable to change the angle of air flow across the inclined trough.

In another embodiment, flexible skirts are positioned perpendicularly to the inclined trough and on either side of a set of overhead air vent nozzles to create a compartmentalized air flow corridor across the inclined trough.

In another embodiment, the plurality of riffles include at least some riffles that are positioned diagonally to the flow of feed material flowing down the inclined trough and to the air flow, such that heavier materials are directed away from the edge of the inclined trough over which the plastics are blown.

In another embodiment, the apparatus further comprises a bar screen located at the feed entry to separate (pre-size) the incoming feed material.

In another embodiment, the apparatus includes at least one cross conveyor to change the direction of the processed feed material at least once.

Figure 2:
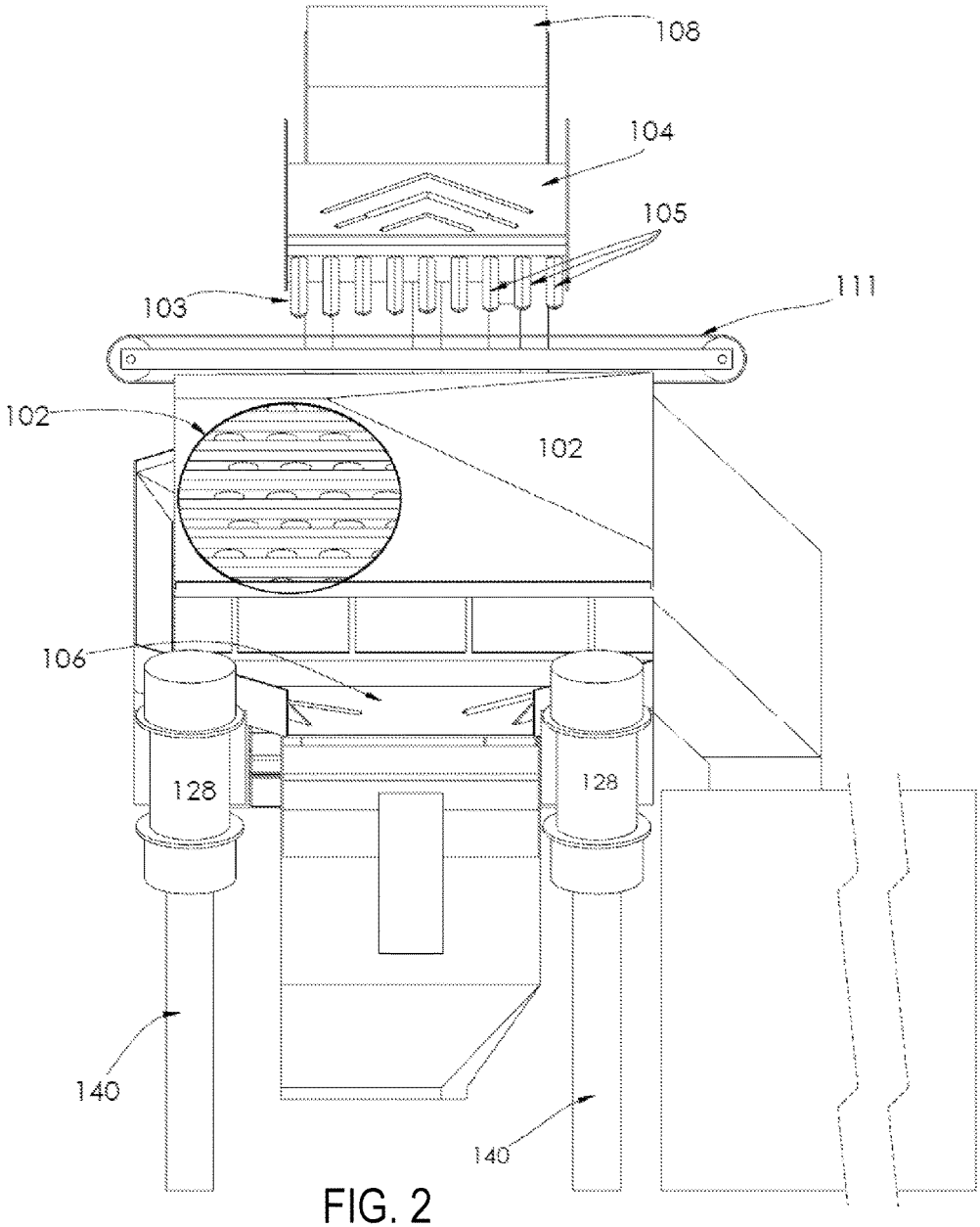
FIG. 2 shows a front view of the apparatus of FIG. 1.
Figure 3:
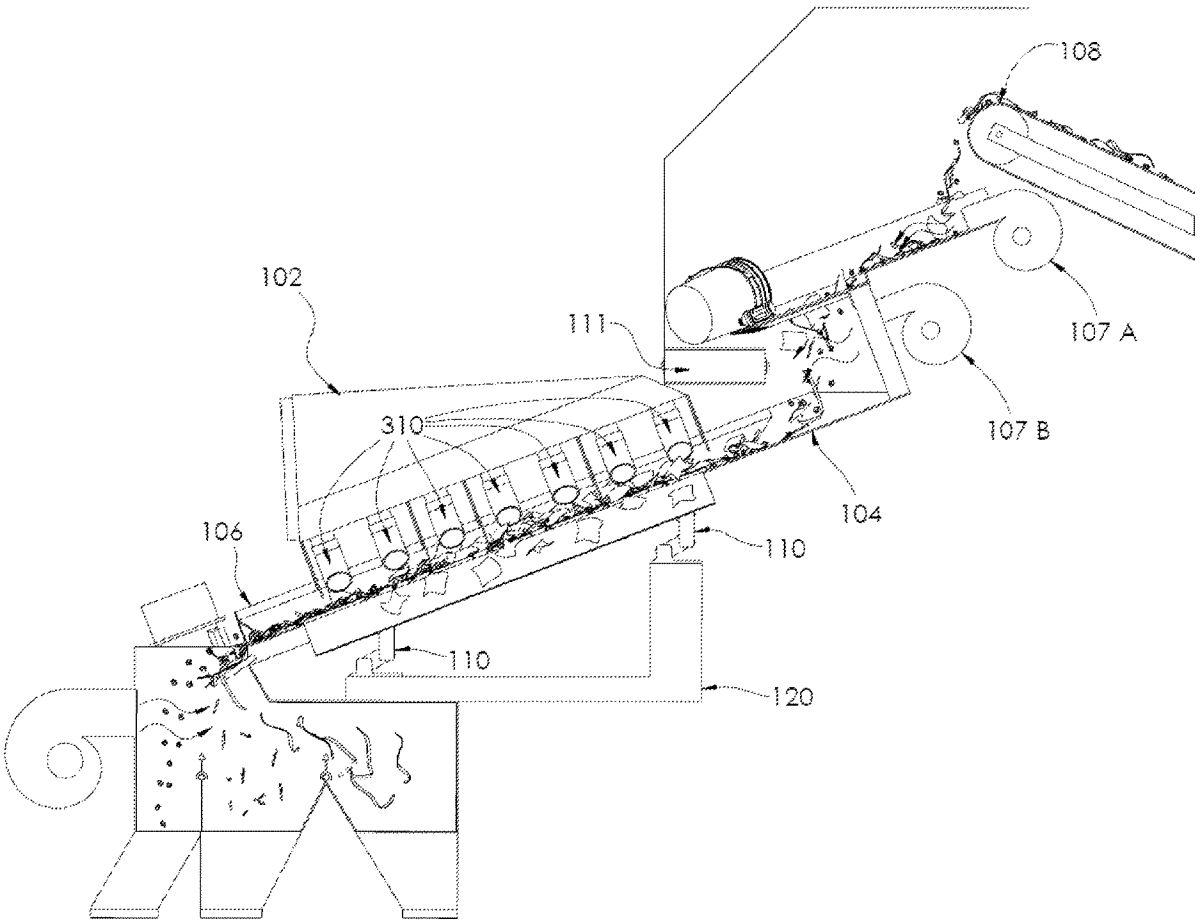
FIG. 3 shows a schematic partial cross-sectional side view of multiple stages of the apparatus of FIG. 1.

By way of example, and not by way of limitation, FIG. 1 shows an illustrative apparatus in accordance with an embodiment. As shown in FIGS. 1 to 3, apparatus 100 comprises a number of stages.

A first stage is a material intake stage with a feed entry 104 for receiving feed material from a feed conveyor 108. In an embodiment, the first stage may include a scalping separator or bar screen 103 which removes oversized objects such as plastic bottles, plastic pails, and other larger objects before they enter the inclined trough (102). In this illustrative example, the screen 103 comprises a plurality of parallel screen bars 105 spaced apart to allow feed material under a particular width to fall through the screen 103 and into the second stage. As will be detailed further below, the scalping screen 103 vibrates under an induced vibration to help direct oversized materials down the parallel screen bars 105. In addition, one or more blowers 107A, 107B may be used to blow light plastics and either directly deposit them onto a cross conveyor 111, or in the case of heavier films, assist their passage down the scalping screen 103 to the cross conveyor 111. The cross conveyor 111 carries the oversized materials to a plastics discharge chute (not shown) and then into a roll off bin (not shown).

Still referring to FIGS. 1 to 3, the second stage includes an inclined trough 102 which receives feed material via feed entry 104 at a top end of the second stage, and discharges processed feed at a materials discharge end 106 at the bottom of the second stage.

While the inclined trough 102 may operate anywhere between about 30 degrees from horizontal and 10 degrees from horizontal, in a preferred embodiment, the incline of trough 102 is approximately 20 degrees from horizontal. This incline has been found through experimentation to provide a good flow of biodegradable material through trough 102, while simultaneously allowing the biodegradable material to attain a hindered settling condition behind each of the riffles 410, 412, 414, 416 on the trough 102.

The inclined trough 102 is preferably mounted to a plurality of flexibly resilient supports 110. The supports 110 may be positioned to keep trough 102 spaced apart but movable relative to an underlying supporting frame 120. The supporting frame 120 may itself be mounted on a base 140 to sufficiently raise the materials discharge end 106 of the second stage to a suitable height and to position a third stage 130 under the material discharge end 106 in order to further separate the processed material, as described below.

In an embodiment, one or more vibratory motors 128 are adapted to induce a vibration to the entire first and second stage of the apparatus, including the inclined trough 102, feed entry 104, and bar screen 103. Preferably, the vibratory motion induced by the vibrating motors 128 is a reciprocating vibratory motion that is symmetrical and linear. This vibratory motion allows the biodegradable material to remain substantially in constant contact with the surface of the trough 102, thus increasing the effects of hindered settling along the length of trough 102 as the biodegradable material travels down the slope of the trough 102.

In a preferred embodiment, the vibratory motion has a frequency in the range from about 600 cycles per minute to about 1200 cycles per minute, at an amplitude range of about 1/16th inch to about ¾ inch. However, vibratory motions outside of this range are also possible.

Figure 4:
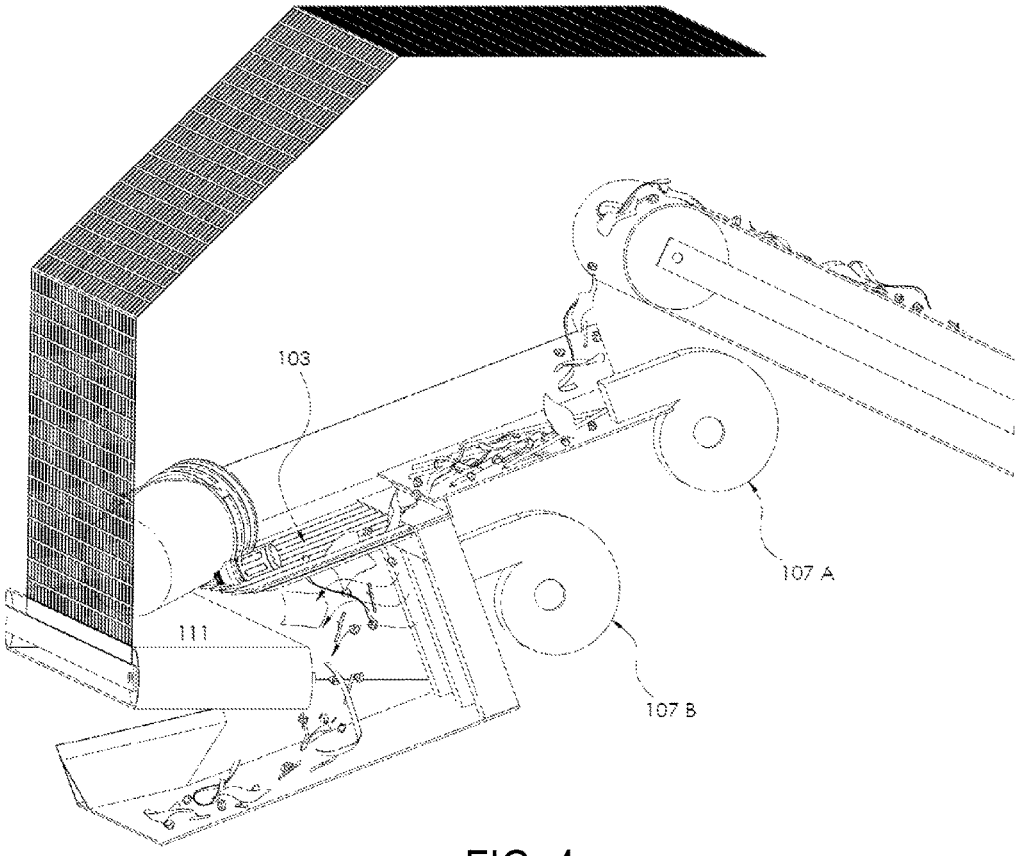
FIG. 4 shows a detailed perspective view of an illustrative feed intake portion of the apparatus of FIG. 1.

Still referring to FIGS. 1 to 3, and now referring to FIG. 4, the feed material that has fallen through the scalping screen 103 enters the inclined trough 102 at the high end. The action of the scalping screen 103 has already removed oversized objects such as damp blankets, pails, and bottles that may hinder the break-up of the flow of feed material. Thus, the feed material that has passed through the scalping screen 103 is sized to spread out evenly over the inclined trough 102.

Figure 5:
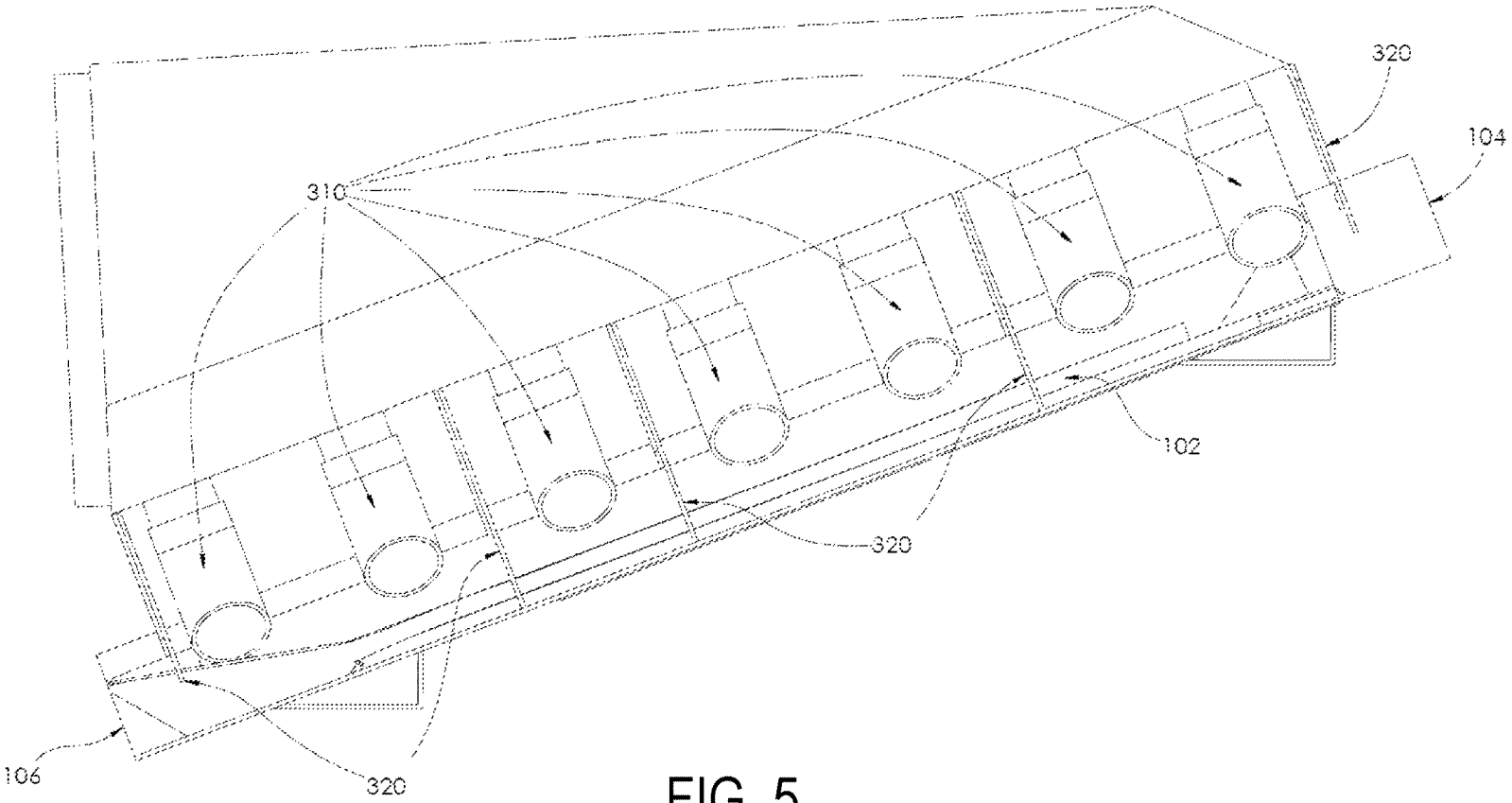
FIG. 5 shows a detailed side view of an inclined trough, having a plurality of overhead air vent nozzles in accordance with an embodiment.

As best shown in FIG. 2 and FIG. 3, and now referring to FIG. 5, the feed material spreads out and flows down the inclined trough 102, and past an air distribution system comprising a plurality of overhead air vent nozzles 310. These overhead air vent nozzles 310 may be spaced apart over the length of the inclined trough 102 as shown, and each row may have more than one overhead air vent nozzle 310 to effectively form a grid of overhead air vent nozzles 310 over the inclined trough.

In an illustrative embodiment that is not meant to be limiting, the grid of overhead air vent nozzles 310 may be 4" internal diameter pipes which are arranged at a spacing of 7" on centre along each row across the trough, and 10" on centre between each row. Each overhead air vent nozzle 310 may be positioned at an exit angle of approximately 60 degrees from horizontal as formed by the top surface of the inclined trough 102.

In an embodiment, this grid of overhead air vent nozzles 310 is adapted to direct air flow perpendicularly across the downward flow of feed material in a generally perpendicular direction. By directing air at a right angle to the material flow down the trough incline, plastics and other contaminants are caught by the air flow and transported across the trough to the plastics discharge chute.

In another embodiment, the plurality of overhead air vent nozzles 310 may be adjustable to vary the amount of air flow across the inclined trough 102, and to vary the angle of air flow across the inclined trough 102. Varying the angle of the overhead air vent nozzles 310 also allows the apparatus to further agitate the plastics to separate them from the feed material flowing down the inclined trough 102.

In another embodiment, the plurality of overhead air vent nozzles 310 may be angled up or down diagonally.

Still referring to FIG. 3, and as detailed in FIG. 5, in an embodiment, a plurality of flexible skirts or baffles 320 are positioned perpendicularly to the inclined trough and on either side of a set of overhead air vent nozzles 310 to create compartmentalized air flow corridors across the inclined trough 102.

Through experimentation, it has been found that an air flow speed in the range of about 300 feet per minute to 600 feet per minute provides good results. However, air flow speeds outside of this range are also possible, given the type of feed material and the type of plastics.

In a preferred embodiment, the lower ends of the baffles 320 are flexible and are adjusted to lightly brush the surface of the feed material as it flows down the inclined trough 102. The effect of this brushing action is twofold.

First, a virtual air channel is formed that in effect creates duct-like conditions formed by the plurality of overhead air vent nozzles 310 above, the trough surface below, and the baffles on either side, which concentrate and direct air and plastic flow directly to the plastic discharge. These compartmentalized air flow corridors contain the air flow across the inclined trough 102 and further agitates and separates the loose plastics to be blown to one side of the inclined trough 102. This greatly improves the transportation ability of the air flow, even with hard plastic fragments, and reduces the volume and force of air required.

A second effect of the baffles 320, is that they tend to trap plastic behind them, whilst the rest of the feed material flows beneath. In effect, they are skimming the plastic off the surface of the feed material, as the feed material passes over the riffles. This skimming effect ensures very effective and thorough separation of even the smallest, barely visible plastic fragments.

While the enhanced air flow significantly increases the ability to direct plastics to one side, the enhanced air flow as described above can also cause lighter or drier organic material to migrate across the trough towards the plastics discharge chute, as the feed material flows down the trough incline. This can cause excessive amounts of organic material to be discharged along with the plastics. To overcome this challenge, the riffle layout has been changed in such a way as to counter the force and action of the air flow.

Figure 6:
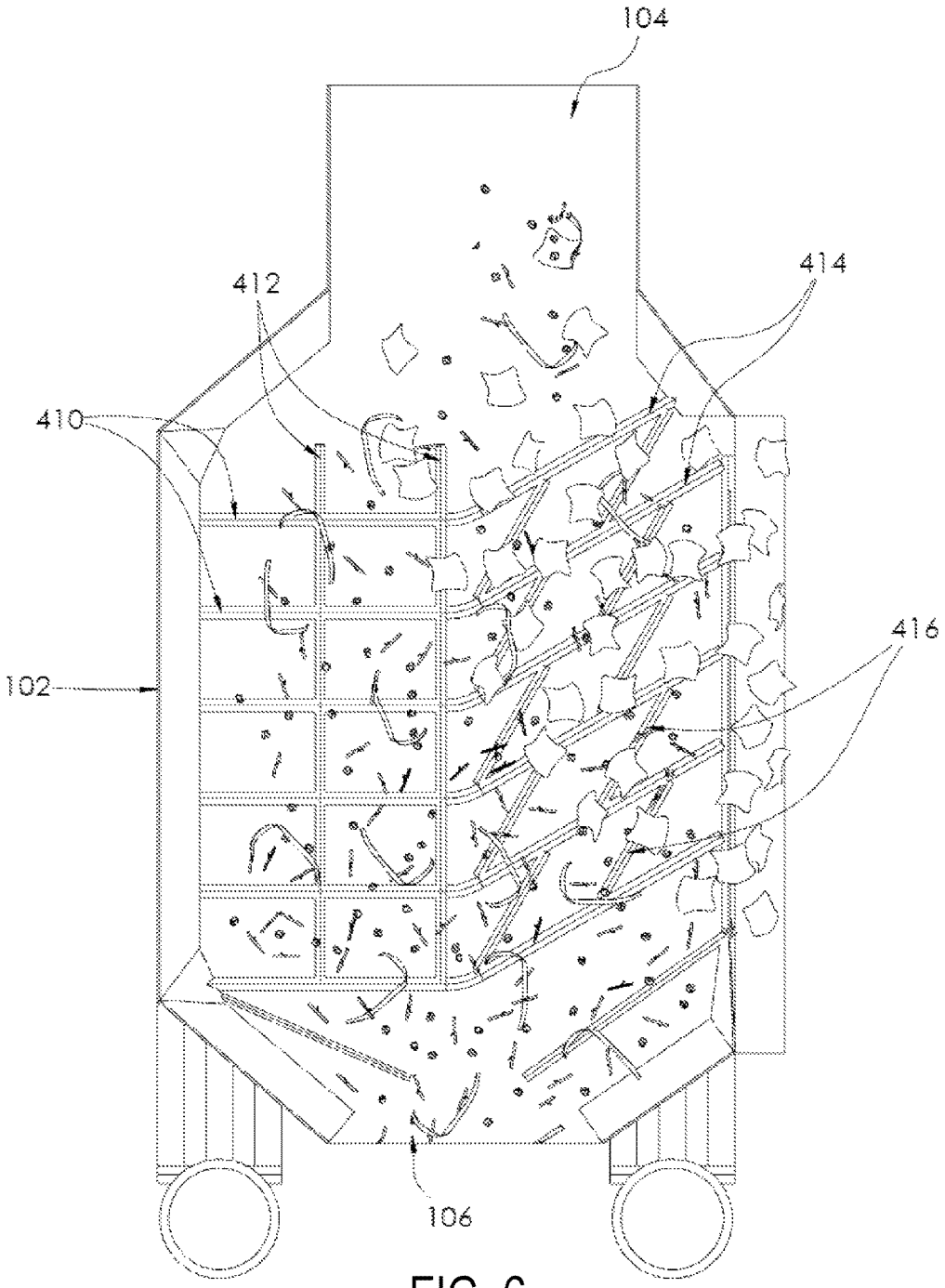
FIG. 6 shows an illustrative top view of the inclined trough showing an arrangement of angled riffles on one side of the trough.

As shown in FIG. 6, in an embodiment, the inclined trough 102 includes a plurality of riffles 410 oriented generally perpendicularly to the flow of feed material down the inclined trough 102. However, in order to direct other feed material other than plastics to continue to flow down the inclined trough, other riffles may be positioned vertically (riffles 412) and diagonally (riffles 414, 416).

In an embodiment, the diagonal riffles 414, 416 may be angled at approximately between 30 degrees and 60 degrees from the parallel riffles 410 and the vertical riffles 412, and positioned to one side of the inclined trough 102 starting approximately half way across the width of the table (in this illustrative example shown in FIG. 6, the right side). These diagonally oriented riffles 414, 416 act against the air flow across the inclined trough 102, and the angle of inclination of the riffles 414, 416 create a resultant force great enough to cancel the effect of the air flow on lighter organic materials, therefore holding the material on the inclined trough 102 rather than allowing it to be carried away over the side edge along with the plastics. In this way, the hindered settling conditions are maintained as successive rows of inclined, angled riffles 414, 416 maintain the direction of flow of feed material down the inclined trough 102. It has been found that by angling the longitudinal riffle in this way, even lighter biodegradable material is effectively separated from the plastics, and directed back to the centre of the table.

The riffles are of a sufficient height and sufficient angle such that while they provide an obstacle to unhindered flow of biodegradable material down inclined trough 102, they do not stop the flow entirely. The dimensions of the riffles 410, 412, 414, 416 including height, profile, and angles may be selected based on the type of biodegradable materials being processed.

In an embodiment, the height of the riffles 410, 412, 414, 416, as measured perpendicular to the trough 102, relates to the particle size and shape of the feed material being processed. The height of the riffles 410, 412, 414, 416 are also related to the design depth or thickness of the bed of feed material as it flows down the trough 102. If the feed material consists mostly of large particles, the feed material may flow over a low riffle without attaining a satisfactory state of hindered settling, thereby reducing separating efficiency.

Adjusting the height of the riffles 410, 412, 414, 416 according to the median particle size is therefore important. In a preferred embodiment, the bed depth, which is the thickness of the material perpendicular to the trough surface as it flows down the incline, is no more than about 1 to 1.5 times the median particle diameter, with the riffle height being about 2 times the median particle diameter.

In a preferred embodiment, the cross section of the riffles 410, 412, 414, 416 is such that each face that constitutes the riffle is inclined at between about 40° to 50° (e.g. 45°) from the surface of the inclined trough 102. Experimentation has shown that other inclinations and riffle face shapes may not perform as well under wide ranging conditions.

In an embodiment, the number of riffles per unit length of the trough, in combination with the trough frequency and amplitude, determine the feed rate for a given separation efficiency. Experimentation has shown that there is a trade-off between the feed rate and the separation efficiency, when contamination is held constant. Separation efficiency drops as feed rate increases. To maintain satisfactory feed rate at 90% to almost 100% separation, it is preferable to space the riffles no less than about 6 inches peak to peak, and no greater than about 12 inches peak to peak. Finer feed material demands the closer riffle spacing, coarser material requires wider spacing.

As flowing biodegradable material meets the perpendicular or diagonal riffles 410, 414, 416, the biodegradable material begins to boil or churn rapidly behind the perpendicular or diagonal riffles 410, 414, 416 before spilling over the peak of the perpendicular or diagonal riffles 410, 414, 416. In other words, perpendicular or diagonal riffles 410, 414, 416 induce hindered settling of the biodegradable material on the surface of trough 102, and together with the vibrating motion of trough 102 induces a constant churn.

As the biodegradable material churns, the plastics contaminants rise to the surface of the churning biodegradable material. It is believed that this separation is due to a combination of phenomena, which include the differences in specific gravity, particle shape, and particle size between the plastic contaminants and the biodegradable materials.

In experimentation, the second stage of apparatus 100 has been found to effectively remove plastics of all shapes, sizes, compositions and densities from biodegradable materials and woodchips. The plastics separation has been found to be effective under a wide range of compost moisture content levels, ranging from about 20% to 60% of water present, relative to the oven dry weight of the sample. It has also been found that the apparatus of the present disclosure will effectively remove plastics of all kinds, shapes and sizes from tiny fragments of film, to plastic bottle tops, to large sheets of film, to shoe soles, and so on. Thus a key advantage is to be able to process a wide range of plastics types in one processing line.

Experimental testing has shown consistently high separation rates under wide ranging conditions of extremely high contamination (up to 20% plastics by volume). Results of separation average 99% film plastic and 96% hard plastics and fibers.

While the above described process has been found to remove a substantial amount of the plastic contaminants, with up to 100% of film plastics in ideal conditions, it has been found that other types of contaminants including stones, glass, and fibers may remain mixed in with the biodegradable materials as they cannot be removed by air flow alone. In order to remove these remaining contaminants to achieve a higher grade of biodegradable material by removing these contaminants, the apparatus includes a third stage comprising a material resilience separator.

Figure 7:
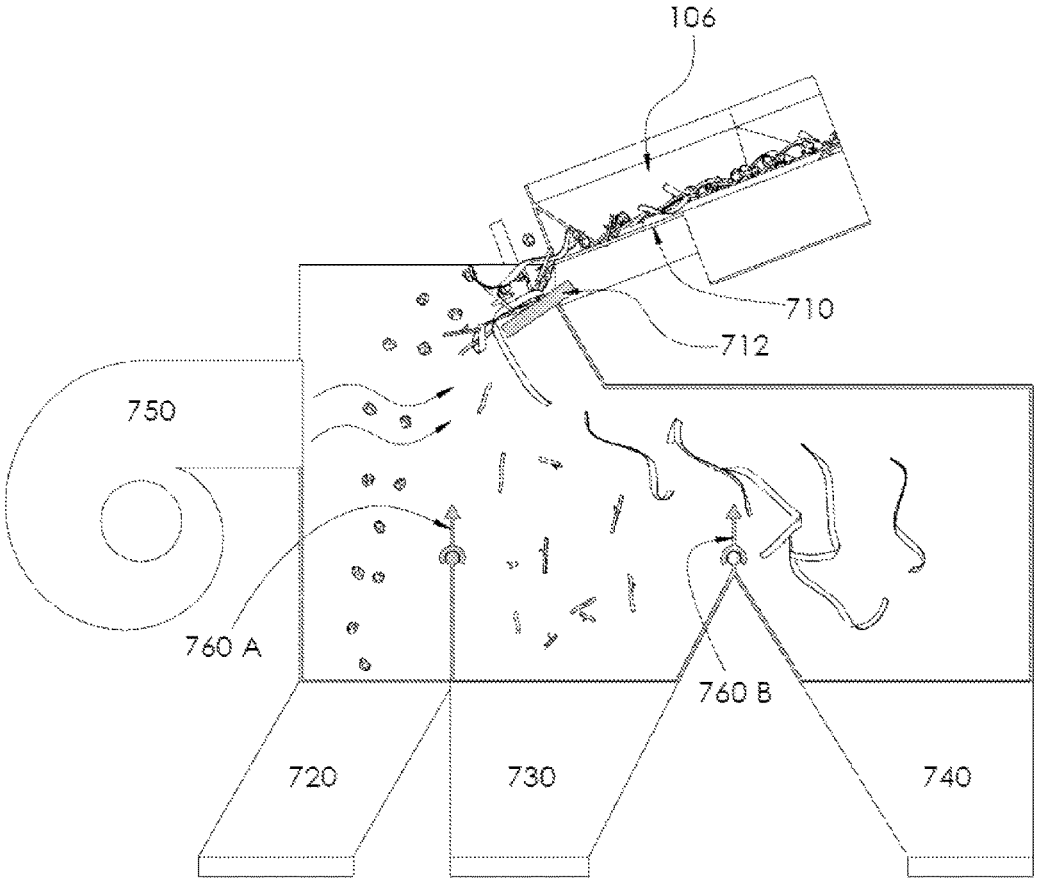
FIG. 7 shows a detailed side view of the resilience separator stage of the apparatus of FIG. 3.

An illustrative embodiment of a material resilience separator third stage is shown in FIG. 7. In a preferred embodiment, the material resilience separator comprises of a static inclined plate 712 situated below the lowest end of the inclined trough 106. As material falls off the end of the vibrating trough and flows over the inclined plate, the angle of the plate is such that hard material such as stone and glass will bounce somewhat and separate from the softer organic material which will fall directly off the plate without bouncing. As the different material types fall away from the plate under the force of gravity, a clear split occurs between the material types. A discharge hopper system has been devised with adjustable blades 760A, 760B located between and separating the plurality of bins, 720,730,740 to improve the efficiency of the split across the processed materials into separated fractions.

In the embodiment shown in FIG. 7, a blower 750 generates a counteracting air flow against the material flowing off the inclined plate 712. Stones, glass and other hard contaminants that are the least affected by the counteracting air flow are directed into a first bin 720. Biodegradable materials which are less hard than the stones and glass and are more affected by the counteracting air flow due to a higher drag coefficient are separated from the stones and glass, and drop into the second or middle bin 730. This airflow particularly important to help differentiate between small stones and glass coated in damp compost and similarly sized pieces of organic matter, which bounce off the inclined plate similarly, but have different drag coefficients. Finally, any fibers or other lighter density materials which are the most affected by the counteracting air flow due to even higher drag coefficients are further separated from the biodegradable materials and fall into a third bin 740 to be collected.

In an embodiment, adjustable bin blades or knives 760A, 760B may be adjusted to change the position of the cutting edges of the bins 720, 730, 740. This allows for adjustment due to changes in material moisture content and feed material properties.

Thus, in an aspect, there is provided an apparatus for separating contaminants from biodegradable materials in a feed material, comprising: an inclined trough having a feed entry at a top end for receiving the feed material, the inclined trough including a plurality of riffles angled to at least partially hinder and unsettle a flow of the feed material flowing down the inclined trough; one or more vibratory motors configured to induce a vibration in the inclined trough; one or more blowers configured to generate an air flow through overhead air vent nozzles positioned over the inclined trough and directing the air flow to one side of the inclined trough; and a material resilience separator for separating the contaminants from the biodegradable materials in the remaining material.

In an embodiment, the material resilience separator comprises an inclined plate adapted to cause contaminants to separate based on differences in material resilience and hardness, whereby contaminants bouncing off the inclined plate assume a trajectory of fall different from the biodegradable materials based on coefficients of elasticity, such that the contaminants are substantially separated from the biodegradable materials.

In another embodiment, the angle of the inclined plate is adapted to be controlled to produce increased separation of the contaminants from the biodegradable materials between a plurality of bins.

In another embodiment, the apparatus further comprises a blower adapted to provide a controlled air flow to increase separation of the contaminants and the biodegradable materials between the plurality of bins.

In another embodiment, the apparatus further comprises adjustable blades located between and dividing the plurality of bins to increase separation of the contaminants from the biodegradable materials.

In another embodiment, the contaminants comprise stones, glass, and synthetic materials including fibers and plastics.

In another embodiment, the apparatus further comprises overhead air vent nozzles are adjustable to change the angle of air flow across the inclined trough.

In another embodiment, the apparatus further comprises flexible skirts positioned perpendicularly to the inclined trough and on either side of a set of overhead air vent nozzles to create a compartmentalized air flow channel across the inclined trough.

In another embodiment, the apparatus further comprises a bar screen located at the feed entry to separate larger contaminants from the incoming feed material.

In another embodiment, the apparatus further comprises at least one cross conveyor to divert the direction of the processed feed material during processing.

In another aspect, there is provided a method of separating contaminants from biodegradable materials in feed material, comprising: supplying the feed material to an inclined trough including a plurality of riffles angled to at least partially hinder and unsettle a flow of the feed material flowing down the inclined trough; inducing a vibration in the inclined trough utilizing one or more vibratory motors; generating an air flow across and to one side of the inclined trough utilizing a plurality of overhead air vent nozzles positioned over the inclined trough; and separating the contaminants from the biodegradable materials in the remaining feed material utilizing a material resilience separator.

In an embodiment, the material resilience separator comprises an inclined plate adapted to cause contaminants to separate based on differences in material resilience and hardness, whereby contaminants bouncing off the inclined plate assume a trajectory of fall different from the biodegradable materials based on coefficients of elasticity, such that the contaminants are substantially separated from the biodegradable materials.

In another embodiment, the method further comprises varying the angle of the inclined plate to increase separation of the contaminants from the biodegradable materials between a plurality of bins.

In another embodiment, the method further comprises providing a controlled air flow to increase separation of the contaminants and the biodegradable materials between the plurality of bins.

In another embodiment, the method further comprises adjusting an angle of blades located between and dividing the plurality of bins to increase separation of the contaminants from the biodegradable materials.

While various embodiments and illustrative examples have been described above, it will be appreciated that these embodiments and illustrative examples are not limiting, and the scope of the invention is defined by the following claims.

The invention claimed is:

1. An apparatus for separating contaminants from biodegradable materials in a feed material, comprising:

an inclined trough having a feed entry at a top end for receiving the feed material, the inclined trough including a plurality of riffles angled to at least partially hinder and unsettle a flow of the feed material flowing down the inclined trough;

one or more vibratory motors configured to induce a vibration in the inclined trough;

a plurality of blowers configured to generate a plurality of angled air flows through overhead air vent nozzles positioned over the inclined trough and directing the plurality of angled air flows to one side of the inclined trough;

a material resilience separator for separating the contaminants from the biodegradable materials in the remaining material; and adjustable blades located between and dividing a plurality of blades to increase separation of the contaminants from the biodegradable materials.

2. The apparatus of claim 1, wherein the contaminants comprise stones, glass, and synthetic materials including fibers and plastics.

3. The apparatus of claim 1, further comprising overhead air vent nozzles are adjustable to change the angle of air flow across the inclined trough.

4. The apparatus of claim 1, further comprising flexible skirts positioned perpendicularly to the inclined trough and on either side of a set of overhead air vent nozzles to create a compartmentalized air flow channel across the inclined trough.

5. The apparatus of claim 1, further comprising a bar screen located at the feed entry to separate larger contaminants from the incoming feed material.

6. The apparatus of claim 1, further comprising at least one cross conveyor to divert the direction of processed feed material during processing.

7. A method of separating contaminants from biodegradable materials in feed material, comprising:

supplying the feed material to an inclined trough including a plurality of riffles angled to at least partially hinder and unsettle a flow of the feed material flowing down the inclined trough;

inducing a vibration in the inclined trough utilizing one or more vibratory motors;

generating an air flow across and to one side of the inclined trough utilizing a plurality of overhead air vent nozzles positioned over the inclined trough;

separating the contaminants from the biodegradable materials in the remaining feed material utilizing a material resilience separator, wherein the material resilience separator comprises an inclined plate adapted to cause contaminants to separate based on differences in material resilience and hardness, whereby contaminants bouncing off the inclined plate assume a trajectory of fall different from the biodegradable materials based on coefficients of elasticity, such that the contaminants are substantially separated from the biodegradable materials;

varying the angle of the inclined plate to increase separation of the contaminants from the biodegradable materials between a plurality of bins; and adjusting an angle of blades located between and dividing the plurality of bins to increase separation of the contaminants from the biodegradable materials.

8. The method of claim 7, further comprising providing a controlled air flow to increase separation of the contaminants and the biodegradable materials between the plurality of bins.

9. The method claim 7, wherein the contaminants comprise stones, glass, and synthetic materials including fibers and plastics.

10. An apparatus for separating contaminants from biodegradable materials in a feed material, comprising:

an inclined trough having a feed entry at a top end for receiving the feed material, the inclined trough including a plurality of riffles angled to at least partially hinder and unsettle a flow of the feed material flowing down the inclined trough;

one or more vibratory motors configured to induce a vibration in the inclined trough;

one or more blowers configured to generate an angled air flow through overhead air vent nozzles positioned over the inclined trough and directing the angled air flow to one side of the inclined trough;

a material resilience separator for separating the contaminants from the biodegradable materials in the remaining material, the material resilience separator comprising an inclined plate adapted to cause contaminants to separate based on differences in material resilience and hardness, the angle of the inclined plate controllable to produce increased separation of the contaminants from the biodegradable materials between a plurality of bins, whereby contaminants bouncing off the inclined plate assume a trajectory of fall different from the biodegradable materials based on coefficients of elasticity, such that the contaminants are separated from the biodegradable materials; and adjustable blades located between and dividing the plurality of bins to increase separation of the contaminants from the biodegradable materials.

* * * * *